US010995445B2

(12) United States Patent
Park

(10) Patent No.: US 10,995,445 B2
(45) Date of Patent: May 4, 2021

(54) WASHING MACHINE

(71) Applicant: LG Electronics Inc., Seoul (KR)

(72) Inventor: Youngryul Park, Seoul (KR)

(73) Assignee: LG Electronics Inc., Seoul (KR)

( * ) Notice: Subject to any disclaimer, the term of this patent is extended or adjusted under 35 U.S.C. 154(b) by 179 days.

(21) Appl. No.: 16/204,404

(22) Filed: Nov. 29, 2018

(65) Prior Publication Data

US 2019/0161900 A1 May 30, 2019

(30) Foreign Application Priority Data

Nov. 29, 2017 (KR) ..... 10-2017-0161810

(51) Int. Cl.

| | |
|---|---|
| ***D06F 37/40*** | (2006.01) |
| ***D06F 23/04*** | (2006.01) |
| *D06F 17/08* | (2006.01) |

(52) U.S. Cl.

CPC ..... *D06F 37/40* (2013.01); *D06F 23/04* (2013.01); *D06F 17/08* (2013.01)

(58) Field of Classification Search

CPC ..... D06F 37/40; D06F 23/04; D06F 17/08
USPC ..... 68/133
See application file for complete search history.

(56) References Cited

U.S. PATENT DOCUMENTS

| | | | | |
|---|---|---|---|---|
| 2010/0050702 | A1* | 3/2010 | Kim | D06F 37/40 68/23 R |
| 2016/0010265 | A1* | 1/2016 | Jang | D06F 37/40 310/71 |
| 2018/0327957 | A1 | 11/2018 | Kim et al. | |

FOREIGN PATENT DOCUMENTS

| | | | |
|---|---|---|---|
| CN | 202543645 | | 11/2012 |
| CN | 105463774 | | 4/2016 |
| CN | 206157407 | | 5/2017 |
| JP | H11244577 | | 9/1999 |
| KR | 1020030073850 | | 9/2003 |
| KR | 10-2004-0071430 | | 8/2004 |
| KR | 1020050064926 | | 6/2005 |
| KR | 101015241 | B1 * | 2/2011 |
| KR | 1020110012366 | | 2/2011 |
| KR | 1020140130353 | | 11/2014 |
| KR | 1020170024252 | | 3/2017 |

OTHER PUBLICATIONS

CN105463774A—Machine translation (Year: 2016).*
KR101015241B1—Machine translation (Year: 2011).*
Australian Office Action in Australian Application No. 2018271319, dated Apr. 24, 2019, 9 pages.
Chinese Office Action in Chinese Appln. No. 201811444273.X, dated Sep. 11, 2020, 15 pages (with English translation).

* cited by examiner

*Primary Examiner* — Tinsae B Ayalew
(74) *Attorney, Agent, or Firm* — Fish & Richardson P.C.

(57) ABSTRACT

A washing machine includes a bearing housing which is installed on a bottom surface of an outer tub, a clutch stopper which is installed on a bottom surface of the bearing housing, and a driving motor which includes a stator and a rotor which are coupled to a lower side of the clutch stopper, in which the clutch stopper includes a base portion which is disposed on the bottom surface of the bearing housing, and a fastening boss which extends from the base portion to the lower side by a predetermined length and is fastened to stator by a fastening member.

20 Claims, 16 Drawing Sheets

WASHING MACHINE

CROSS-REFERENCE TO RELATED APPLICATIONS

The present application claims priority under 35 U.S.C. 119 and 35 U.S.C. 365 to Korean Patent Application No. 10-2017-0161810 (filed on Nov. 29, 2017), which is hereby incorporated by reference in its entirety.

BACKGROUND

The present invention relates to a washing machine.

Generally, a washing machine includes a tub in which washing water is accommodated, and a drum which is rotatably provided in the tub to accommodate clothing, or the like (hereinafter, referred to as "washing cloth"), and as the drum rotates, the washing and dewatering of the washing cloth is performed.

The washing machine is classified into a top loading type in which a rotation center of the drum is formed vertically and is designed to be capable of inputting the washing cloth from an upper side thereof and a front loading type in which the rotation center of the drum is formed horizontally or is formed so as to be inclined in a direction which is lowered toward a rear end and is designed to be capable of inputting the washing cloth from a front side thereof.

The top loading type washing machine can be roughly classified into an agitator type and a pulsator type. The agitation type rotates washing rods rising at the center of the drum to wash the washing cloth and the pulsator type rotates a disc-shaped pulsator or the claim which is formed under the drum to wash the washing cloth.

The front loading type is generally referred to as a drum washing machine, and a lifter is provided on an inner circumferential surface of the drum. As the drum rotates, the lifter lifts and drops the washing cloth to perform the washing.

Korean Patent Laid-Open No. 10-2004-0071430 (Aug. 12, 2004) (hereinafter, referred to as related art) discloses a top loading type automatic washing machine.

The washing machine disclosed in the related art is provided with a driving unit which includes a driving motor for providing a driving force, a dewatering shaft for rotating the tub, a washing shaft for driving the pulsator, and a coupler for selectively driving the dewatering shaft and the washing shaft.

The coupler transfers rotation force generated in the driving motor to the pulsator at the time of washing and at the same time to the pulsator and the tub at the time of dewatering. In other words, the washing shaft is always coupled to the driving motor, and the dewatering shaft is selectively coupled to the driving motor.

To this end, the coupler is engaged with the dewaxing shafts so as to be movable up and down and has a serration that can be engaged with the rotor of the driving motor on the outer circumferential surface thereof. Accordingly, when the coupler is lifted, the coupling between the dewatering shaft and the rotor is released, and when the coupler is lowered, the coupler is engaged with the rotor to transfer the rotation force of the rotor to the dewatering shaft.

Meanwhile, the washing machine disclosed in the related art has the following problems.

First, in the washing machine of the related art, a stator of the driving motor is fastened to a bottom surface of a bearing housing by a fastening member. A clutch stopper is provided between the stator and the bearing housing to restrict rotation of a clutch lever.

At this time, an upper mouthing surface of the stator and a lower surface of the clutch stopper come into direct contact with each other to be fastened. In this case, there is a problem that vibration generated in the driving motor is transferred to a side of the bearing housing through the clutch stopper, thereby generating a large noise.

Second, in the related art, there is no structure for keeping the operation amount (rotation amount) of the clutch lever constant. Therefore, the operation amount of the clutch lever is not kept constant, and friction between the clutch lever and a relative member (for example, coupling) that contacts the clutch lever increases, thereby causing component wear.

Third, the fastening force of the fastening member for fixing the stator is gradually weakened by the vibration caused by the high-speed operation of the motor. When the fastening force of the fastening member is weakened, the abnormal noise due to the eccentricity of the components increases.

SUMMARY

The present invention is proposed so as to improve the problems described above, an objective of the present invention is to provide a washing machine which is capable of minimizing noise transferred to a bearing housing through a clutch stopper by minimizing a contact surface between an upper mounting surface of the stator and a lower surface of the clutch stopper.

Another objective of the present invention is to provide a washing machine which is capable of keeping the operation amount (rotation amount) of a clutch lever for raising and lowering the coupler constant.

A still another objective of the present invention is to provide a washing machine which is capable of improving the fastening force of a fastening member for fastening the stator and preventing the lowering of the fastening force due to the temperature change of the clutch stopper.

A still another objective of the present invention is to provide a washing machine which can facilitate the assembly between the driving motor and a relative structure which is coupled with the driving motor.

In order to accomplish the above objectives, the washing machine of the present invention includes a driving unit mounted on an outer surface of an outer tub to provide a driving force for rotating an inner tub and a pulsator.

The driving unit may include a bearing housing which is installed on a bottom surface of the outer tub, a clutch stopper which is installed on a bottom surface of the bearing housing, and a driving motor which includes a stator and a rotor coupled to a lower side of the clutch stopper.

At this time, the clutch stopper may include a base portion which is disposed on the bottom surface of the bearing housing, and a fastening boss which extends downward from the base portion by a predetermined length and fastened to the stator by a fastening member.

In addition, the driving unit may include a driving motor which includes a stator and a rotor, a bearing housing which is fixed to the bottom surface of the outer tub, a planetary gear module which is rotatably installed in the bearing housing, a dewatering shaft which is coupled to the planetary gear module, and rotates the inner tub by selectively receives a rotation force of the rotor, a washing shaft which is positioned in the dewatering shaft, is connected to the planetary gear module, and receives a rotation force of the rotor to rotate the pulsator.

In addition, the driving unit may include a coupler winch vertically moves along an outer circumferential surface of the dewatering shaft and selectively connects the dewatering shaft and the rotor, and a clutch mechanism which selectively connects the dewatering shaft and the rotor by vertically moving the coupler.

At this time, the clutch mechanism includes a clutch stopper which is mounted on the bottom surface of the bearing housing and a clutch lever which has one end portion rotatably connecting to a side of the clutch stopper and the other end portion connecting to the coupler to push up the coupler, and a plurality of fastening bosses are extended by a predetermined length on a bottom surface of the clutch stopper and the stator is connected to the plurality of fastening bosses so that an upper surface of the stator and the bottom surface of the clutch stopper are spaced apart from each other by a predetermined distance.

Therefore, the clutch stopper serves as a damper between the bearing housing and the stator, and it is possible to minimize the vibration transferred from the driving motor to the bearing housing through the clutch stopper.

In which the clutch stopper is disposed at a lower portion of the bearing housing, and includes a base portion in which an opening through which the dewatering shaft passes is formed, a plurality of main flanges which extends from an outer edge of the base portion, and a plurality of dummy flanges which extends from the outer edge of the base portion and disposed alternately with the plurality of main flanges in the circumferential direction of the base portion.

At this time, the plurality of fastening bosses extend from the bottom surface of the main flange, the inner circumferential surface of the stator is formed with a plurality of fastening protrusion portions which protrude toward the center of the stator and spaced apart in the circumferential direction of the stator, the plurality of the fastening boss may contact a portion of the plurality of fastening protrusion portions, and a fastening member sequentially passing through the fastening protrusion portion and the fastening boss may be inserted into the bottom surface of the bearing housing.

In addition, the washing machine may further include a plurality of upper guide portions which protrudes from upper surfaces of the plurality of dummy flanges, respectively and a plurality of lower guide portions which extends from the bottom surface of the main flange and is formed at a position spaced apart from the fastening bosses. At this time, the plurality of upper guide portions are inserted into holes formed in the bottom surface of the bearing housing, and the plurality of lower guide portions can be inserted into holes formed in the inner edge of the stator.

In addition, the clutch stopper may further include a plurality of inner flanges which extends from the inner edge of the base portion and an auxiliary coupling portion which protrudes from an upper surface of the inner flange, and the fastening member passing through the auxiliary coupling portion can be inserted into the bottom surface of the bearing house.

In addition, the washing machine may further include a sleeve tube formed with a metal material which is inserted in the fastening boss.

In addition, a seating portion on which the clutch lever is seated is formed on one side of the bottom surface of the base portion, a pair of hinge coupling portions to which the hinge shafts of the clutch lever are coupled are extended to both side end edges of the seating portion, and a stopper rib which limits the rotation amount of the clutch lever protrudes from the seating portion.

In addition, the stopper rib may protrude from the left and right edges of the seating portion, respectively and the end portion of the stopper rib may be inclined upwards from the outer side toward the center of the base.

In addition, in a washing mode, the clutch lever rotates in a direction of pushing up the coupler toward the bearing housing, and rotation of the clutch lever is restricted when the upper surface of the clutch lever is in contact with the inclined surface.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is illustrated by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Hereinafter, a top-loading type washing machine in which washing clothes are taken in and out through the upper portion of the washing machine will be described as an example.

Figure 1:
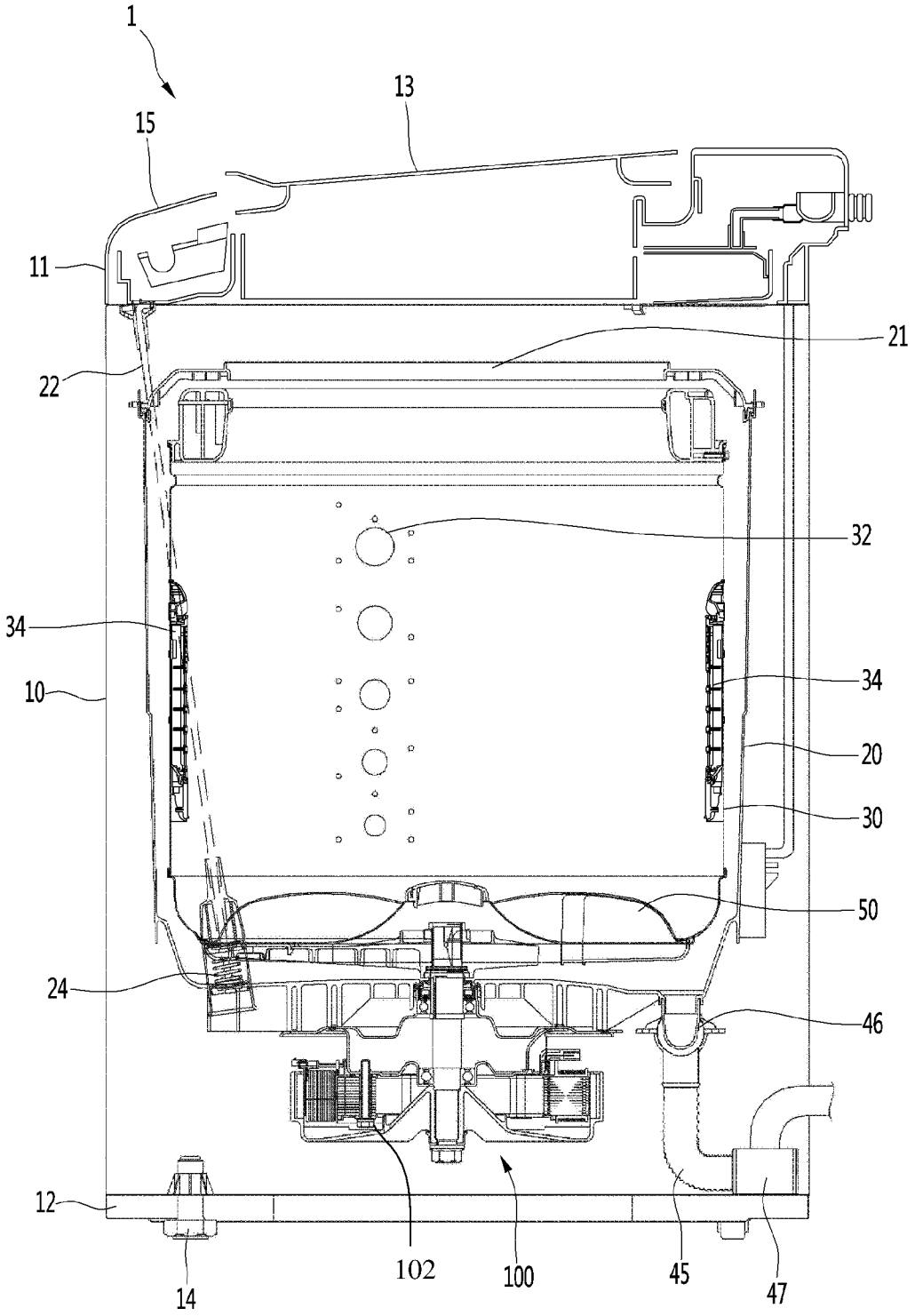
FIG. 1 is a sectional view illustrating a washing machine according to an embodiment of the present invention.

FIG. 1 is a sectional view illustrating a washing machine according to an embodiment of the present invention.

Referring to FIG. 1, a washing machine 1 according to an embodiment of the present invention includes a case 10 forming an outer appearance, a top cover 11 disposed at an upper end of the case 10, and a base 12 disposed at the lower end of the case 10.

The case 10 is formed in a rectangular shape having an inner space, and the upper end and the lower end thereof are opened. In the case 10, various devices necessary for washing may be provided.

The top cover 11 forms a washing input port (not illustrated) which is disposed at the opened upper end of the case 10 and into which the washing can be input. A door 13 is provided on the top cover 11 to open and close the washing input port. For example, the door 13 may be rotatably provided by a user.

The base 12 is disposed to shield the opened lower end of the case 10. One or more legs 14 are disposed on the bottom surface of the base 12 to separate the base 12 from the bottom surface. The leg 14 may be rotated to adjust the level of the washing machine 1.

In addition, the washing machine 1 includes a control panel 15 composed of various devices which are capable of controlling the washing machine 1. The control panel 15 may be provided on the top surface of the top cover 11.

The control panel 15 may include various input units provided for the user to operate the washing machine 1 and a display unit for displaying the state of the washing machine 1 to the user. In addition, the control panel 15 may be provided with various PCBs (not illustrated) or the like for controlling the configuration of the washing machine 1 according to signals input by the input unit.

A cylindrical outer tub 20 and an inner tub 30 are installed in the inner space of the washing machine 1 formed by the case 10, the top cover 11, and the base 12. The inner tub 30 has a smaller diameter than the outer tub 20 so as to be accommodated inside the outer tub 20.

The outer tub 20 is filled with washing water for washing the washing clothes. The outer tub 20 is formed in a cylindrical shape, and an opening portion 21 through which the washing clothes can be taken in and out is formed on the upper surface thereof.

The outer tub 20 may be installed in the case 10 by the support member 22 in a state of being spaced apart from the base 12 upward. For example, the upper end of the support member 22 may be supported on the upper portion of the case 10, and the lower end thereof may be coupled with the lower portion of the outer tub 20. In addition, a damper 24 for absorbing vibration generated in the outer tub 20 and the inner tub 30 may be provided at the lower end of the support member 22.

The damper 24 may include a spring that absorbs vibration which is generated in the inner tub 30 or a driving unit 100 to be described below and is transferred to the outer tub 20, through the elastic deformation.

The inner tub 30 may be defined as a washing tub which is rotated by a driving unit 100 to be described below for washing, rinsing, and dewatering the washing clothes. The inner tub 30 can be accommodated in the outer tub 20 and the outer surface of the inner tub 30 is spaced apart from the inner surface of the outer tub 20 by a predetermined distance.

A plurality of washing holes 32 are formed in the side surface of the inner tub 30 to allow the washing water to flow in and out. Therefore, the washing water supplied to the outer tub 20 can be filled into the inner tub 30 through the plurality of washing holes 32.

In addition, an inner circumferential surface of the inner tub 30 may be provided with a filter unit 34 for collecting various foreign matters including lint contained in the washing water. A plurality of filter units 34 may be installed in the circumferential direction of the inner tub 30.

Meantime, the washing machine 1 is provided with a water supply flow path connected to an external water source to supply washing water into the outer bath 20 and the inner bath 30. The water supply flow path is provided with a water supply valve for opening and closing the water supply flow path. A plurality of water supply valves may be provided depending on the kind of water to be supplied. For example, the water supply valve may include a hot water valve and a cold water valve.

In addition, a drainage flow path 45 for draining washing water from the outer tub 20 and the inner tub 30 to the outside of the washing machine 1 is provided in the washing machine 1. The drainage flow path 45 is provided with a drain valve 46 for opening and closing the drainage flow path 45. In addition, the drainage flow path 45 may further include a drain pump 47 for pumping the washing water drained to the drainage flow path 45 to the outside.

In addition, a pulsator 50, which forms a water flow for washing, is rotatably provided on the bottom of the inner tub 30.

In addition, the washing machine 1 is provided with a driving unit 100 for providing power for rotating the inner tub 30 or the pulsator 50. The driving unit 100 includes a dewatering shaft for rotating the inner tub 30 and a washing shaft for rotating the pulsator 50 and selectively rotates the dewatering shaft and the washing shaft.

Figure 2:
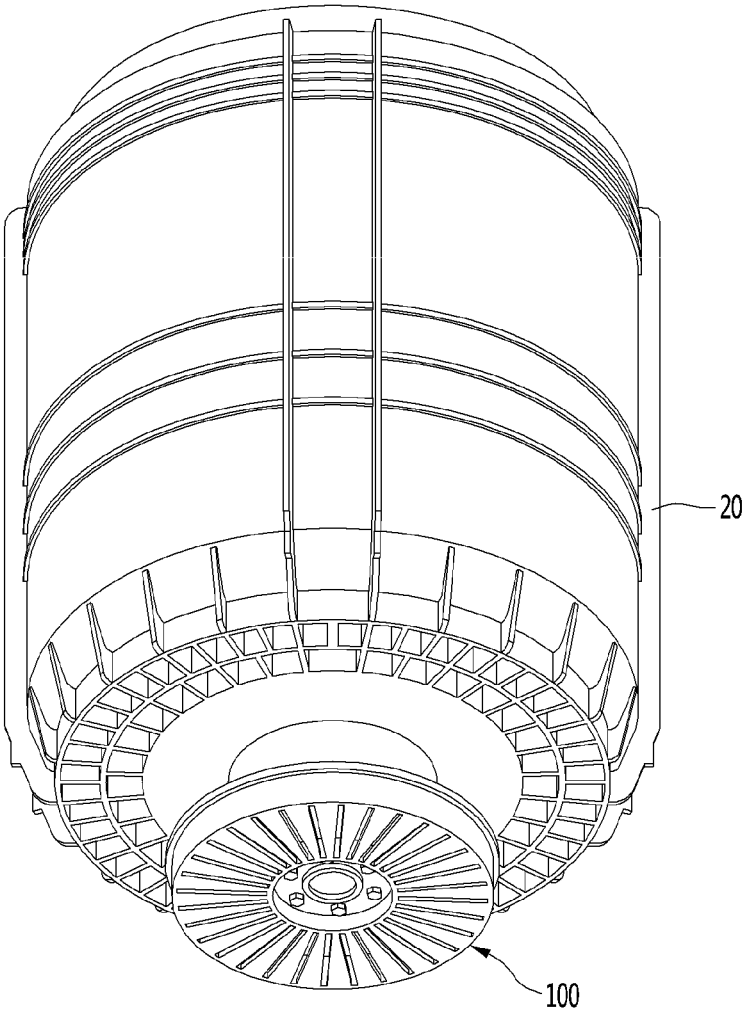
FIG. 2 is a perspective view illustrating a state where a driving unit according to an embodiment of the present invention is installed on an outer tub.
Figure 3:
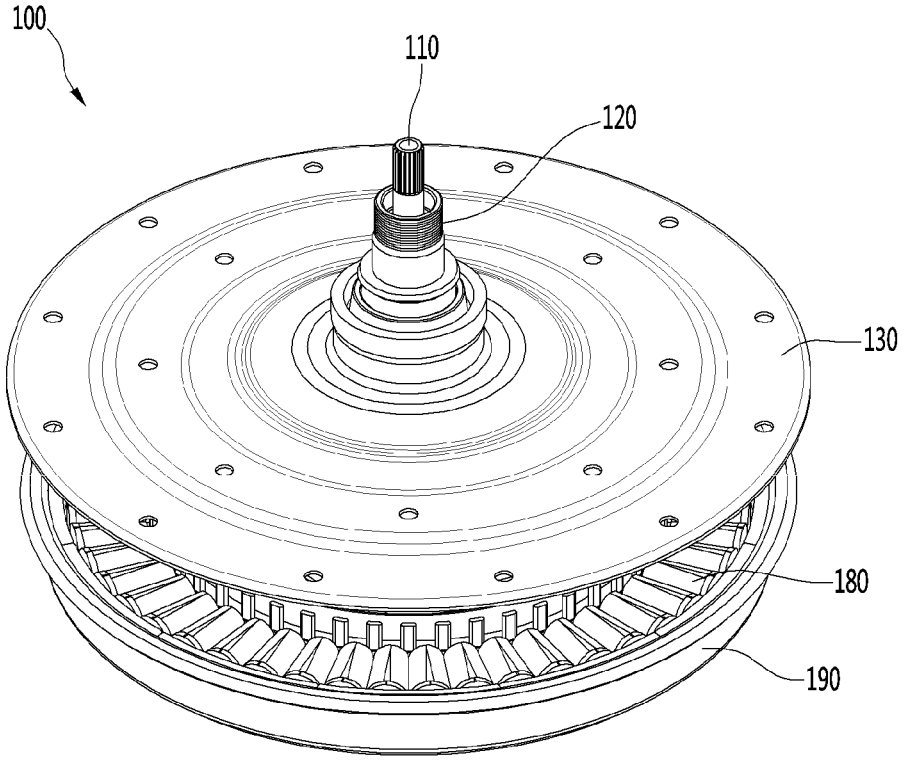
FIG. 3 is a perspective view illustrating the driving unit.
Figure 4:
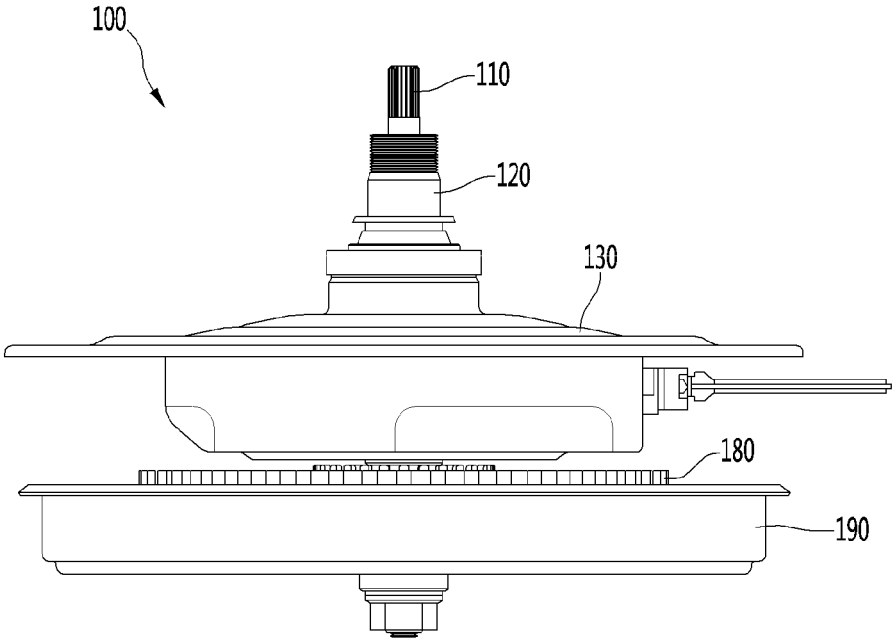
FIG. 4 is a side view illustrating the driving unit.

FIG. 2 is a perspective view illustrating a state where a driving unit according to an embodiment of the present invention is installed on an outer tub, FIG. 3 is a perspective view illustrating the driving unit, and FIG. 4 is a side view illustrating the driving unit.

Referring to FIGS. 2 to 4, the driving unit 100 according to the embodiment of the present invention is disposed on the outer surface of the outer tub 20. Specifically, the driving unit 100 is disposed below the outer surface of the outer tub 20. The driving unit 100 can be understood as means for providing power for rotating the pulsator 50 or rotating the pulsator 50 and the inner tub 20 together.

The driving unit 100 may include a washing shaft 110 for transferring power to the pulsator 50, a dewatering shaft 120 for transferring rotation power to the inner tub 30, a bearing housing 130 supporting the washing shaft 110 and the dewatering shaft 120 and a driving motor 180,190 disposed at a lower portion of the bearing housing 130 to provide a driving force to the washing shaft 110 or the dewatering shaft 120.

Hereinafter, the driving unit 100 will be described in more detail with reference to the drawings.

Figure 5:
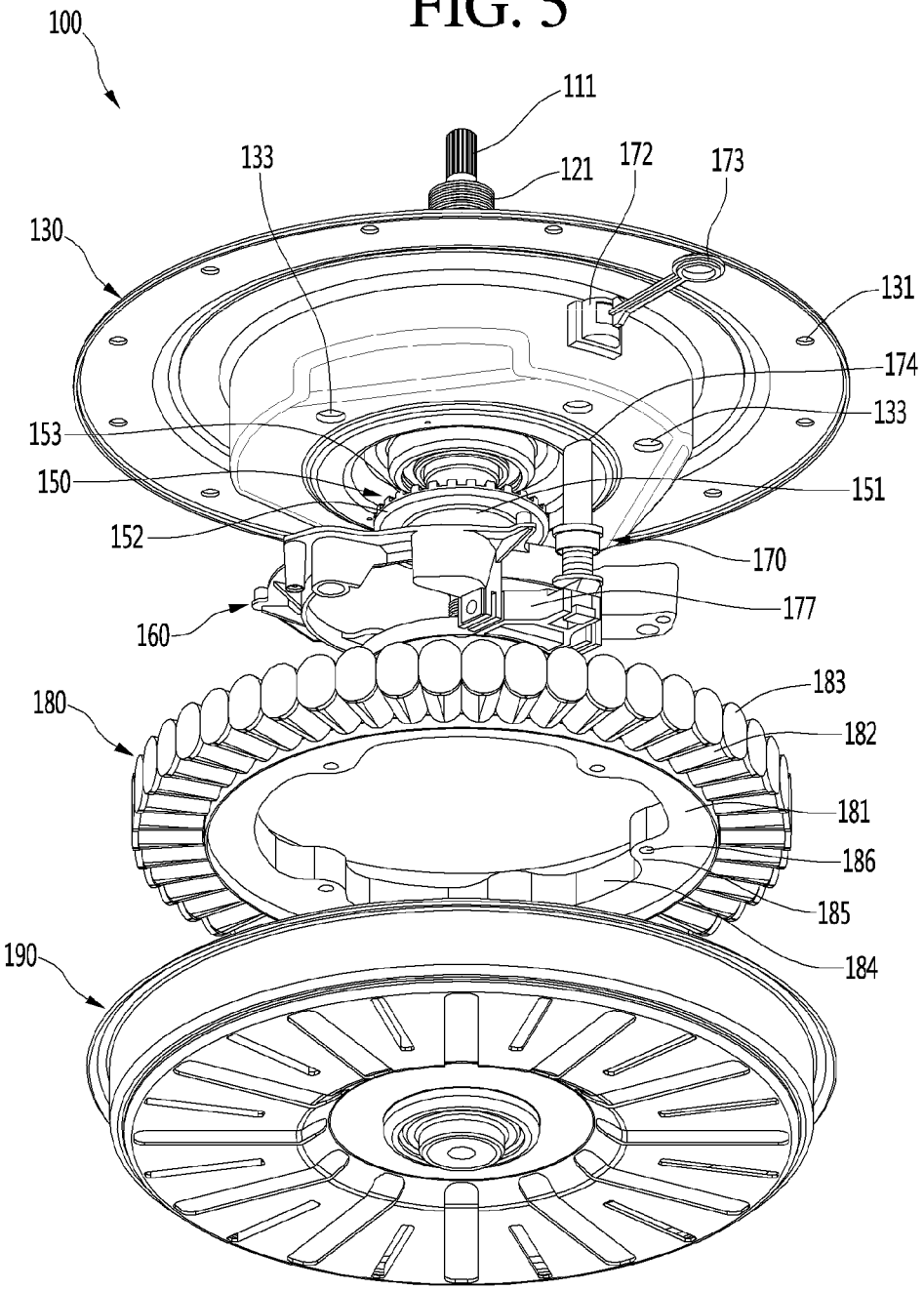
FIG. 5 is an exploded perspective view illustrating the driving unit.
Figure 6:
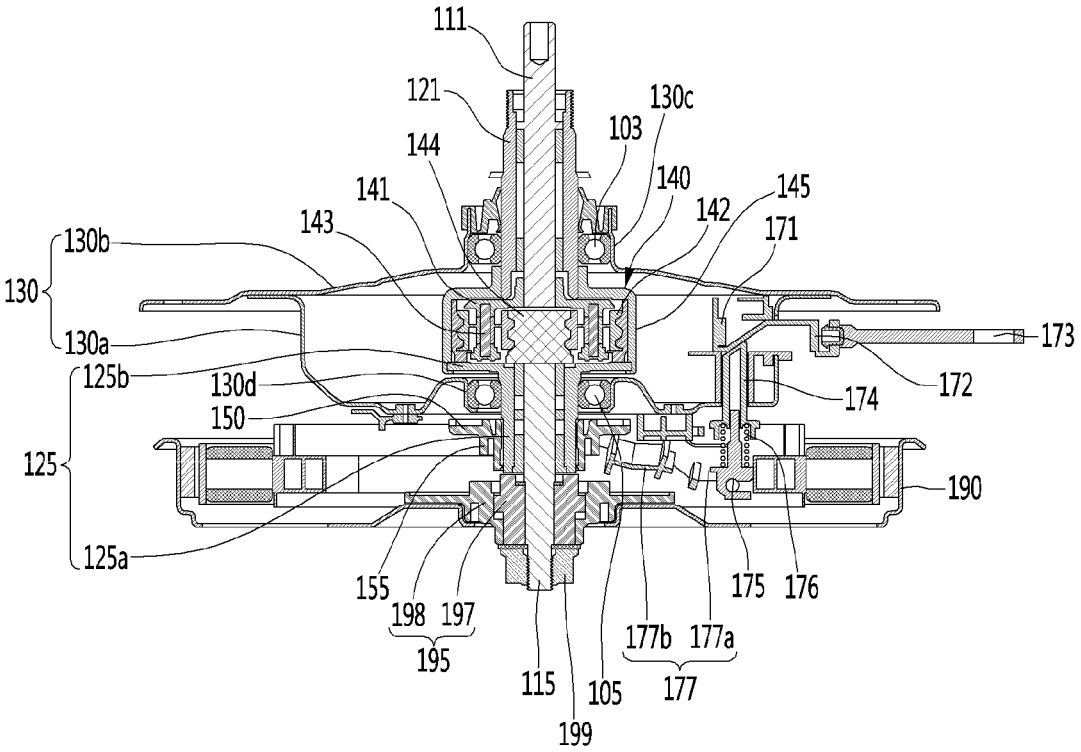
FIG. 6 is a longitudinal sectional view illustrating the driving unit.
Figure 7:
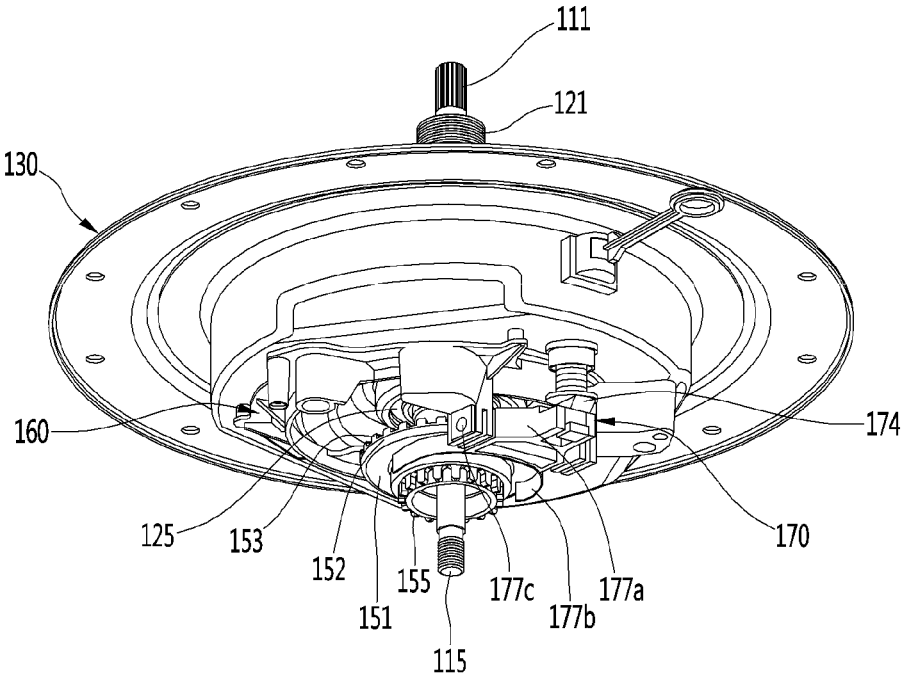
FIG. 7 is a perspective view illustrating a state where the driving motor is removed from the driving unit.
Figure 8:
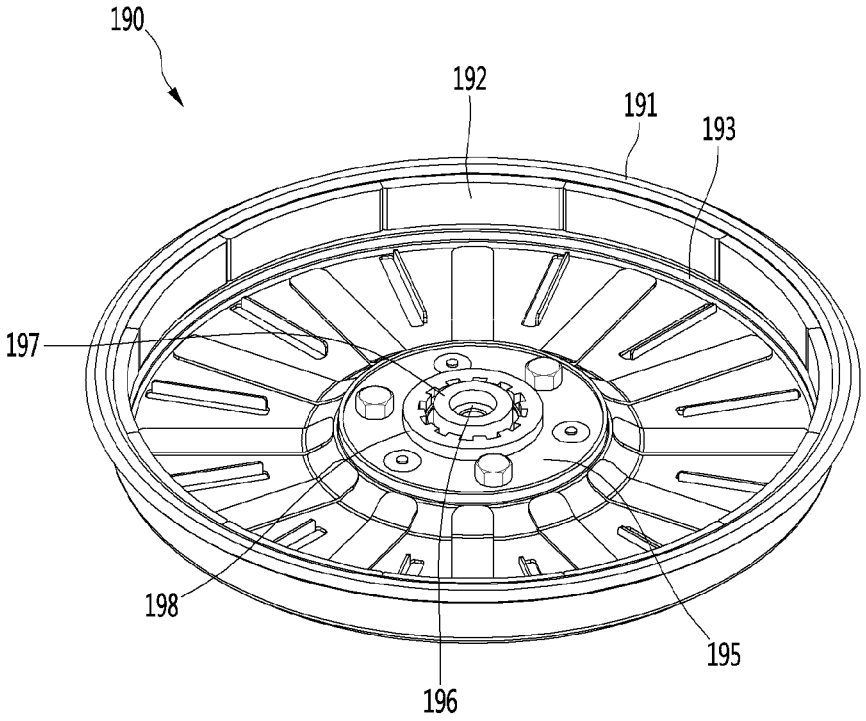
FIG. 8 is a perspective view illustrating a rotor of the driving unit.

FIG. 5 is an exploded perspective view illustrating the driving unit, FIG. 6 is a longitudinal sectional view illustrating the driving unit, FIG. 7 is a perspective view illustrating a state where: the driving motor is removed from the driving unit, and FIG. 8 is a perspective view illustrating a rotor of the driving unit.

Referring to 5 to 8, the driving unit 100 includes a washing shaft 110, a dewatering shaft 120, a bearing housing 130, and driving motors 180 and 190, as described above.

In detail, the washing shaft 110 includes an upper washing shaft 111 and a lower washing shaft 115 located below the upper washing shaft 111. The dewatering shaft 120 includes an upper dewatering shaft 121 and a lower dewatering shaft 125 located below the upper dewatering shaft 121.

The upper washing shaft 111 protrudes into the interior of the inner tub 30 through the center of the upper dewatering shafts 120 and one end portion of the upper washing shaft 111 protruding into the inner tub 30 is coupled to the pulsator 50. The other end portion of the upper washing shaft 111 extends downward and is connected to a planetary gear module 140 disposed inside the bearing housing 130.

The upper washing shaft 111 is fixed to the bottom portion of the inner tub 30 and rotates together with the inner tub 30 as one body.

The lower washing shaft 115 is spaced apart from the upper washing shall 111 downward. A lower end portion of the lower washing shaft 115 is connected to the rotor 190 of the driving motor and an upper end portion of the lower washing shaft 115 is connected to the planetary gear module 140. In other words, the planetary gear module 140 connects the lower end of the upper washing shaft 111 and the upper end of the lower washing shaft 115.

The upper washing shaft 111 is inserted into the upper dewatering shaft 121 and the upper dewatering shaft 121 and the upper washing shaft 111 is concentric with each other. One end portion of the upper dewatering shaft 121 is coupled to the inner tub 30 to transfer the rotation force to the inner tub 30 and the other end portion thereof is connected to the planetary gear module 140.

The lower dewatering shaft 125 is disposed downward from the upper dewatering shaft 121. The lower washing shaft 115 are inserted into the lower dewatering shaft 125 and the lower dewatering shaft 125 and the lower washing shafts 115 are concentric. The upper end portion of the lower dewatering shafts 125 is connected to the planetary gear module 140 and the lower end portion thereof is coupled to the rotors 190 by the couplers 150 to be described below, and thus the lower dewatering shaft receives the rotation force. At this time, a serration for engaging with the coupler 150 is funned on the outer circumferential surface of the lower dewatering shaft 125. Accordingly, the coupler 150 is installed to be movable up and down along the lower dewatering shaft 125.

The rotation force generated in the driving motor is reduced through the planetary gear module 140 and transferred to the upper washing shaft 111 and/or the upper dewatering shaft 121 by the construction of the present invention. Therefore, the pulsator 50 or the inner tub 30 is rotated at a relatively high torque, so that the driving motor can be efficiently operated, and as a result, the driving motor can be made slim.

The bearing housing 130 supports the washing shaft 110 and the dewatering shaft 120 and receives a planetary gear module 140 having a plurality of gears therein. The bearing housing 130 is disposed on the lower side of the outer tub 20. The bearing housing 130 may be fixed to the bottom surface of the outer tub 20 by a fastening member. A plurality of fastening holes 131 may be formed in the upper edge of the bearing housing 130 to allow the fastening member to pass therethrough and the plurality of fastening holes 131 may be spaced apart in the circumferential direction of the housing 130. The fastening member passing through the fastening hole 131 is inserted and fixed to the bottom surface of the outer tub 20.

The bearing housing 130 forms an internal space for accommodating the planetary gear module 140. Specifically, the bearing housing 130 may include a housing case 130*a* accommodating the planetary gear module 140 at the center thereof and a housing cover 130*b* covering the opened upper surface of the housing case 130*a*. The plurality of fastening holes 131 may be disposed at an outer edge of the housing cover 130*b*.

In addition, a clutch stopper 160 may be coupled to the lower portion of the bearing housing 130 by a fastening member 102 (see FIG. 1). Specifically, a plurality of fastening holes 133 for inserting the fastening member 102 may be formed on the bottom surface of the housing case 130*a*. The clutch stopper 160 can be mounted on the bottom surface of the bearing housing 130 by inserting the fastening member 102 into the fastening hole 133 through the clutch stopper 160.

The plurality of fastening holes 133 may be three, but the present invention is not limited thereto, and the plurality of fastening holes can be disposed at equal intervals.

Meanwhile, the upper washing shaft 111 and the upper dewatering shaft 121 are inserted through the center of the upper surface of the bearing housing 130, that is, the center portion of the housing cover 130*b*.

Specifically, a sleeve 130*c* for inserting a bearing may extend at the center portion of the housing cover 130*b* and the upper dewatering shaft 121 may penetrate the sleeve 130*c* and be connected to the planetary gear module 140. An upper shaft support bearing 103 is interposed between the outer circumferential surface of the upper dewatering shaft 121 and the sleeve 130*c* so that the upper dewatering shaft 121 is rotatably supported. The upper shaft support bearing 103 prevents the frictional force from being generated between the upper dewatering shaft 121 and the sleeve 130*c* when the upper dewatering shaft 121 rotates.

In addition, the lower washing shaft 115 and the lower dewatering shaft 125 are inserted through the center of the bottom portion of the bearing housing 130 that is, the center of the bottom portion of the housing case 130*a*. A sleeve 130*d* extends from the bottom portion of the housing case 130*a* and the lower dewatering shaft 125 is connected to the planetary gear module 140 through the sleeve 130*d*. A lower shaft support bearing 105 is provided between the sleeve 130*d* and the lower dewatering shaft 125 so that the lower dewatering shaft 125 is rotatably supported.

The driving motor is disposed below the bearing housing 130. The driving motor includes a stator 180 generating a magnetic force by an applied power and a rotor 190 rotated by an induced electromotive force through interaction between the stator 180 and the rotor 190.

Specifically, the stator 180 includes a yoke portion 181 which is formed by stacking magnetic cores (not illustrated) on an inner circumferential surface thereof, a pole 183 which projects radially from a side surface of the yoke portion 181, is spaced apart in the circumferential direction of the yoke portion 181, and on which coil 182 is wound, and an insulator 184 which covers the outer circumferential surface of the magnetic core and preventing direct contact between the coil 182 and the magnetic core.

In addition, the stator 180 further includes a fastening protrusion portion 185 protruding from the inner circumferential surface of the yoke portion 181, specifically, from the inner circumferential surface of the insulator 184, in the center direction of the yoke portion 181. The fastening protrusion portion 185 is a portion for fastening the stator 180 to the beating housing 130 with a fastening member.

A fastening hole 186 is formed in the fastening protrusion portion 185 and the fastening member is inserted into the bottom surface of the bearing housing 130 through the fastening hole 186.

At this time, the clutch stopper 160 is interposed between the stator 180 and the bearing housing 130, and the fastening member 102 sequentially penetrates the stator 180, the clutch stopper 160, and the bearing housing 130 sequentially.

In addition, a plurality of the fastening protrusion portions 185 may be disposed in the circumferential direction on the inner circumferential surface of the yoke portion 181. The plurality of fastening protrusion portions 185 may be disposed at equal intervals.

FIG. 5 illustrates that six fastening protrusion portions 185 are formed on the inner circumferential surface of the yoke portion 181. In the present invention, however, the fastening members penetrate and inserted only into three fastening protrusion portions 185 among the six fastening protrusion portions 185, that is, the stator 180 is coupled to the bearing housing 130 at three points. According to such a three-point fastening structure, there is an advantage that the vibration transferring amount is reduced as compared with the driving unit of the related art which forms the six-point fastening structure. Specifically, when the vibration generated in the driving motor is transferred to the bearing housing 130 via the clutch stopper 160, since the number of fastening members as the transferring medium is reduced from 6 to 3, the vibration transferring amount is reduced.

The rotor 190 is a portion that rotates due to an electrode difference with respect to the stator 180. The rotor 190 is disposed to surround the outer circumferential surface of the stator 180. For example, the rotor 190 may have a flat cylindrical shape with an opened upper surface. The stator 180 may be disposed inside the rotor 190 through the opened upper surface to configure an outer rotor type motor.

Specifically, referring to FIG. 8, the rotor 190 includes a rotor frame 191 forming an outer appearance, and a magnet 192 attached to an inner wall of the rotor frame 191. The magnet 192 is mounted on the inner wall of the rotor frame 191 to form a step 193 for supporting the lower end portion of the magnet 192.

A shaft coupling portion 195 for coupling the lower washing shaft 115 and the lower dewatering shaft 125 is provided at the center portion of the rotor 190. The shaft coupling portion. 195 includes a shaft fastening boss 197 having a shaft through-hole 196 through which the lower washing shaft 115 penetrates and a tooth engaging portion 198 which is formed on the outer side of the shaft fastening boss 197 and is engaged with the serration of the coupler 150.

The shaft coupling portion 195 is fixedly coupled to the rotor 190 and rotates integrally with the rotor 190. A nut 199 is fitted to an end portion of the lower washing shaft 115 passing through the shaft coupling portion 195 so that the lower washing shaft 115 is configured to rotate together with the shaft coupling portion 195 and the rotor 190 as one body.

Meanwhile, the planetary gear module 140 constituting the driving unit 100 is means for increasing the torque transferred to the pulsator 50 by reducing the rotation force generated by the driving motor.

Specifically, the planetary gear module 140 includes a planetary gear case 145, a sun gear 144 accommodated in the planetary gear case 145, and a plurality of planetary gears 142 engaging with the outer circumferential surface of the sun gear 144, and a carrier 141 for supporting a plurality of planetary gears 144.

More specifically, a plurality of gear shafts 143 for fitting the planetary gears are disposed in the carrier 141 in a circumferential direction and a through-hole through which the gear shaft 143 passes is formed at the center portion of the planetary gears 142. With this structure, the carrier 141 supports the plurality of planetary gears 142 and is rotatable together with the planetary gears 142. A sun gear 144 is disposed at the center of the plurality of planetary gears 142 and the planetary gear 142 is engaged with the sun gear 144 to rotate. At the same time, the plurality of planetary gears 142 are engaged with the serration formed on the inner circumferential surface of the planetary gear case 145 and rotate.

An upper end portion of the lower dewatering shaft 125 is fixed to a bottom surface of the planetary gear case 145 so that the lower dewatering shaft 125 and the planetary gear case 145 rotate in one body. As illustrated in the drawings, the lower dewatering shaft 125 has a cylindrical shaft portion **125*a* through which the lower washing shaft 115 passes, and a circular support portion 125*b* extending from the upper end of the shaft portion 125*a* in a direction perpendicular to the shaft portion 125*a*, that is, in the horizontal direction. The support portion 125*b* forms a bottom surface of the planetary gear case 145 to support the sun gear 144 and the planetary gears 142. The upper end of the planetary gear case 145 is connected to the upper dewatering shaft 121 in one body. In addition, a rounded octagonal groove may be formed on the upper portion of the carrier 141 to be engaged with the lower end portion of the upper washing shaft 111. Accordingly, the carrier 141 rotates with the upper washing shaft 111** as one body.

The sun gear 144 is connected to the upper end portion of the lower washing shaft 115. In the washing mode, the rotation force generated by the driving motor is transferred in the order of the sun gear 144, the planetary gear 142, the carrier 141, and the upper washing shaft 111 via the lower washing shaft 115. The rotation force generated by the driving motor is converted into a form in which the rotation speed is decreased by the planetary gear module 140 but the torque is increased and transferred to the upper washing shaft 111.

In addition, the driving unit 100 further includes the coupler 150. The coupler 150 is coupled to the outer circumferential surface of the lower dewatering shaft 125 and is movable in a vertical direction (up and down direction) along the lower dewatering shaft 125. The coupler 150 is vertically moved along the lower dewatering shaft 125 to selectively transfer rotation force generated by rotation of the rotor 190 to the lower dewatering shaft 125 and the lower washing shaft 115.

Specifically, the coupler 150 includes a cylindrical body 151 having a serration on a top surface and a bottom surface thereof. A through-hole (not illustrated) is formed at the center of the body 151 to allow the lower dewatering shaft 125 to pass therethrough. The inner circumferential surface of the through-hole is formed with a serration to be engaged with the outer circumferential surface of the lower dewatering shaft 125.

The coupler 150 descends along the lower dewatering shaft 125 in a state where a serration formed on the inner circumferential surface of the through-hole is engaged with a serration formed on the outer circumferential surface of the lower dewatering shaft 125, and the serration formed on the lower surface of the coupler 150 is coupled to the tooth engaging portion 198 of the rotor 190. When the coupler 150 rises, the serration formed on the lower surface of the coupler 150 and the tooth engaging portion 198 of the rotor 190 are separated.

A flange portion 152 expanding in the radial direction of the body 151 is formed at the upper end portion of the body 151. A stop gear 153 may be formed along the circumferential direction at an upper edge of the flange portion 152. In addition, a connecting gear 155 is formed along a circumferential direction at a lower end edge of the body 151 to engage with a tooth engaging portion 198 of the shaft coupling portion 195.

A compression spring (not illustrated) is provided between the upper surface of the coupler 150 and the lower shaft support bearing 105 to push the coupler 150 downward when the mode is switched from the washing mode to the dewatering mode.

In addition, the driving unit 100 may further include a clutch mechanism 170 that switches the power transferring path of the driving motor to the washing shaft 110 or the dewatering shafts 120 in response to a washing or dewatering cycle. The clutch mechanism 170 functions to move the coupler 150 to the raised position by the operation of the clutch motor.

In detail, the clutch mechanism 170 includes a clutch motor (not illustrated) provided below the outer tub 20, a cam (not illustrated) coupled to a driving shaft of the clutch motor, a lever guide 171 which is fixed in the bearing housing 10, and a lever 172 which is linearly reciprocated under the guidance of the lever guide 171 when the clutch motor is turned on or off.

In addition, the clutch mechanism 170 is provided between the cam of the clutch motor and the lever 172 and is provided with a connecting rod 173 tier pulling the lever 172 toward the clutch motor in accordance with the driving of the clutch motor and a return spring (not illustrated) having one end portion fixed to the lever guide 171 and the other end portion fixed to the lever 172 to apply a return force to the lever 172.

In addition, the clutch mechanism 170 includes a mover 174 descending on the inclined surface of the lever 172 when the clutch motor is turned on and a plunger 174 moving up and down along the guide groove in the mover 174, and a buffer spring 176 provided on the outer circumferential surface of the plunger 175.

A clutch lever 177 is provided at a lower end portion of the plunger 175 to substantially support the coupler 150. One end portion of the clutch lever 177 is coupled to the plunger 175 and the other end portion of the clutch lever 177 contacts the coupler 150 to raise and lower the coupler 150.

Specifically, the clutch lever 177 may include a connection portion 177*a* which is coupled to an end portion of the plunger 175, a support portion 177*b* which extends from the connection portion 177*a* toward the coupler 150, and fixing pin 177*c* which extends both side edges of the connection portion 177*a* and serves as the rotation center of the clutch lever 177. The fixing pin 177*c* may be defined as a hinge shaft.

One end portion of the connection portion 177*a* is connected to the end portion of the plunger 175, and the support portion 177*b* is formed at the other end portion thereof. The connection portion 177*a* and the support portion 177*b* may be formed horizontally. The fixing pin 177*c* passes through the connection portion 177*a* in a lateral direction and is coupled to a clutch stopper 160, which will be described below. In other words, the support portion 177*b* is hinged to the clutch stopper 160 by the fixing pin 177*c* and is installed to be rotatable by a predetermined amount.

The support portion 177*b* protrudes from the end portion of the connection portion 177*a* toward the coupler 150 to raise and lower the coupler 150. The support portion 177*b* functions to press the coupler 150 to the raised position when switching to the washing mode.

The support portion 177*b* extends from the end of the connection portion 177*a* toward the coupler 150 in a state of being divided into both sides so that the support portion 177*b* and the connection portion 177*a* are Y-shaped. In addition, two end portions of the extended support portion 177*b* may be disposed to surround the edge of the coupler 150.

For example, at least a portion of the support portion 177*b* may cover the outer circumferential surface of the body 151 of the coupler 150. A portion of the upper surface of the support portion 177*b* may be in contact with the lower surface of the flange portion 151 of the coupler 150. At this time, the support portion 177*b* may be disposed to be hooked on the outer circumferential surface of the coupler 150 or may be fixed to a portion of the outer circumferential surface of the coupler 150. In other words, various methods other than the method illustrated in the embodiment of the present invention can be proposed as a method of contacting the support portion 177*b* with the coupler 150.

In addition, the driving unit 100 may further include a clutch stopper 160 for limiting the rotation amount of the clutch lever 177. The clutch stopper 160 functions to suppress the movement of the coupler 150 so as to prevent the impact from transferring to the clutch motor, the washing shaft 110, or the dewatering shaft 120 due to rotation of the coupler 150 after the coupler 150 is disengaged from the rotor 190.

The clutch stopper 160 is fixed to the bottom surface of the hearing housing 130 by a fastening member.

In addition, the clutch lever 177 is hinged to the clutch stopper 160 so as to be rotatable. The clutch stopper 160 guides the clutch lever 177 to stably raise and lower the coupler 150.

Hereinafter, the operation of the driving unit will be described in detail with reference to the drawings.

First, the operation of the driving unit according to the washing cycle (or washing mode) will be described with reference to FIG. 6. When a washing command is input to the washing machine 1, the clutch motor of the clutch mechanism 170 is turned on. When the clutch motor is turned on, the connecting rod 173 is pulled toward the clutch motor so that the lever 172 is pulled together.

When the lever 172 is pulled toward the clutch motor, the mover 174 is lowered on the inclined surface of the lever 172. At this time, when the plunger 175 is lowered together with the mover 174, the clutch lever 177 is rotated upward by the pushing force of the plunger 175.

At this time, as the clutch lever 177 is moved upward, the clutch lever 177 pushes the coupler 150 upward, and the coupler 150 is raised along the lower dewatering shaft 125. Then, the coupler 150 is disengaged from the rotor 190 and engaged with the lower dewatering shaft 125. In this case, the coupler 150 moves out of the rotor 190, and only the washing shaft 110 rotates when the rotor 190 rotates.

In other words, in the washing mode, since the serration formed on the inner circumferential surface of the coupler 150 is in a state of being engaged with only the serration of the outer circumferential surface of the lower dewatering shaft 125, and is in a state of being not engaged with the serration of the tooth engaging portion 198 engaged with the lower washing shaft 115, the rotation force of the rotor 190 is transferred only to the pulsator 50 through the washing shaft 110.

Specifically, in the process of transferring the rotation force of the rotor 190 in the washing mode, the rotation force by the rotor 190 is sequentially transferred to the shaft fastening boss 197 of the rotor 190, the lower washing shaft 115 coupled to the shaft fastening boss 197, the sun gear 144, the planetary gear 142, the carrier 141, and the upper washing shaft 111.

Meanwhile, the operation of the driving unit according to the dewatering stroke (or dewatering mode) will be described with reference to the drawings.

Figure 9:
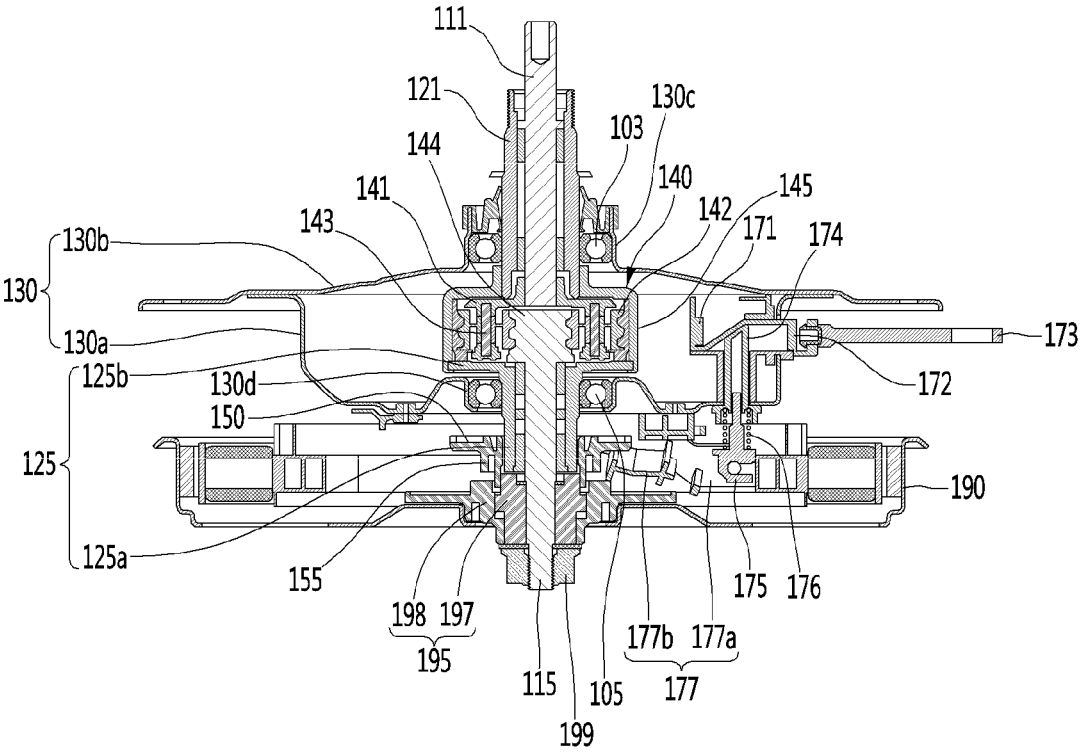
FIG. 9 is a longitudinal sectional view illustrating a driving unit in a dewatering mode according to an embodiment of the present invention.

FIG. 9 is a longitudinal sectional view illustrating a driving unit in a dewatering mode according to an embodiment of the present invention.

Referring to FIG. 9, when a dewatering command is input to the washing machine 1, the clutch motor of the clutch mechanism 170 is turned off. When the clutch motor is turned off, the connecting rod 173 pulled toward the clutch motor is returned to its original position, and the mover 174 is raised on the inclined surface of the lever 172. At this time, when the plunger 175 is raised together with the mover 174, the clutch lever 177 rotates downward.

At this time, as the clutch lever 177 is moved downward, the coupler 150 is lowered due to the own weight thereof and the pushing force of the compression spring. The connecting gear 155 formed at the lower portion of the coupler 150 is engaged with the tooth engaging portion 198 of the rotor 190 when the coupler 150 is completely lowered along the lower dewatering shaft 125.

In other words, when the coupler 150 is completely lowered, the coupler 150 is coupled to the rotor 190 and coupled to the lower dewatering shaft 125. In this case, the coupler 150 simultaneously transfers the rotation force generated by the rotor 190 to the lower washing shaft 115 and the lower dewatering shaft 125, so that the washing shaft 110 and the dewatering shaft 120 are rotated at a high speed and the dewatering proceeds.

In addition, when the sun gear 144 rotates with the lower washing shaft 115 in the planetary gear module 140 due to the rotation of the washing shaft 110 and the dewatering shaft 120, as one body, the planetary gear 142 revolves around the sun gear 144 while engaged with the sun gear 144 without rotating. Therefore, the washing shaft 110 and the dewatering shaft 120 rotate at the same rotation speed.

Hereinafter, the clutch stopper will be described in detail with reference to the drawings.

Figure 10:
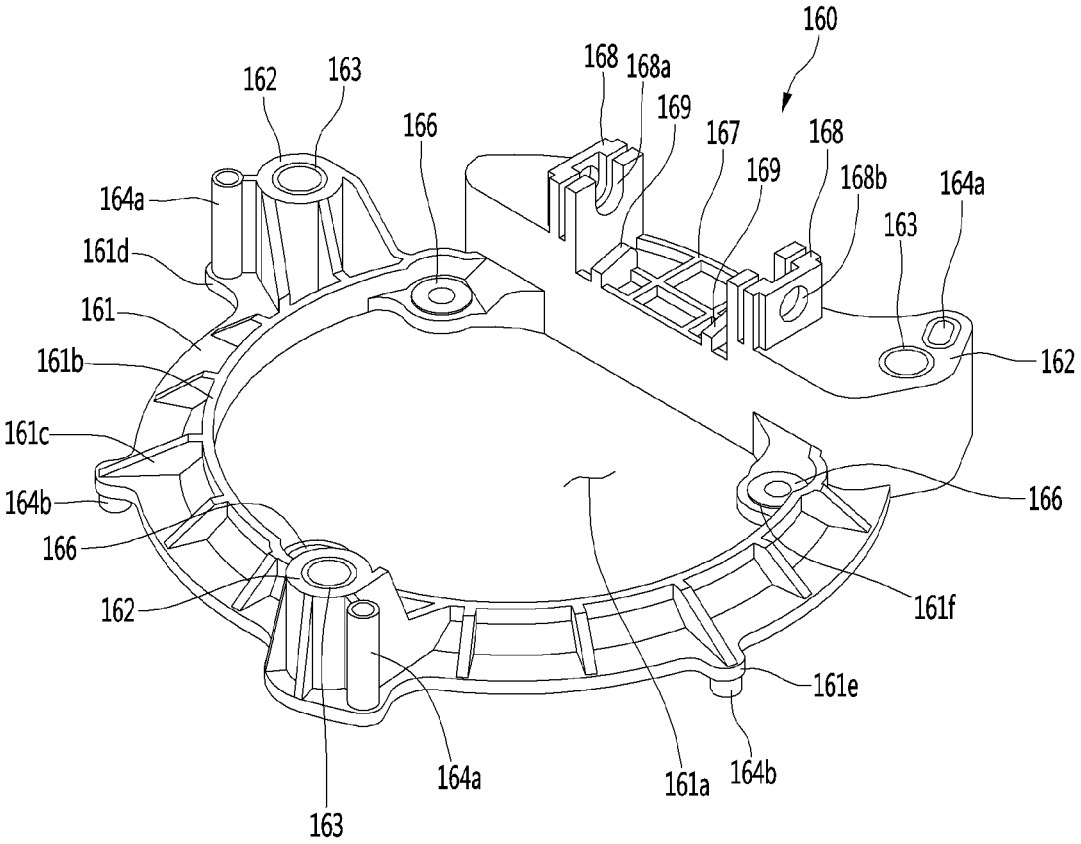
FIG. 10 is a bottom perspective view illustrating a clutch stopper according to an embodiment of the present invention.
Figure 11:
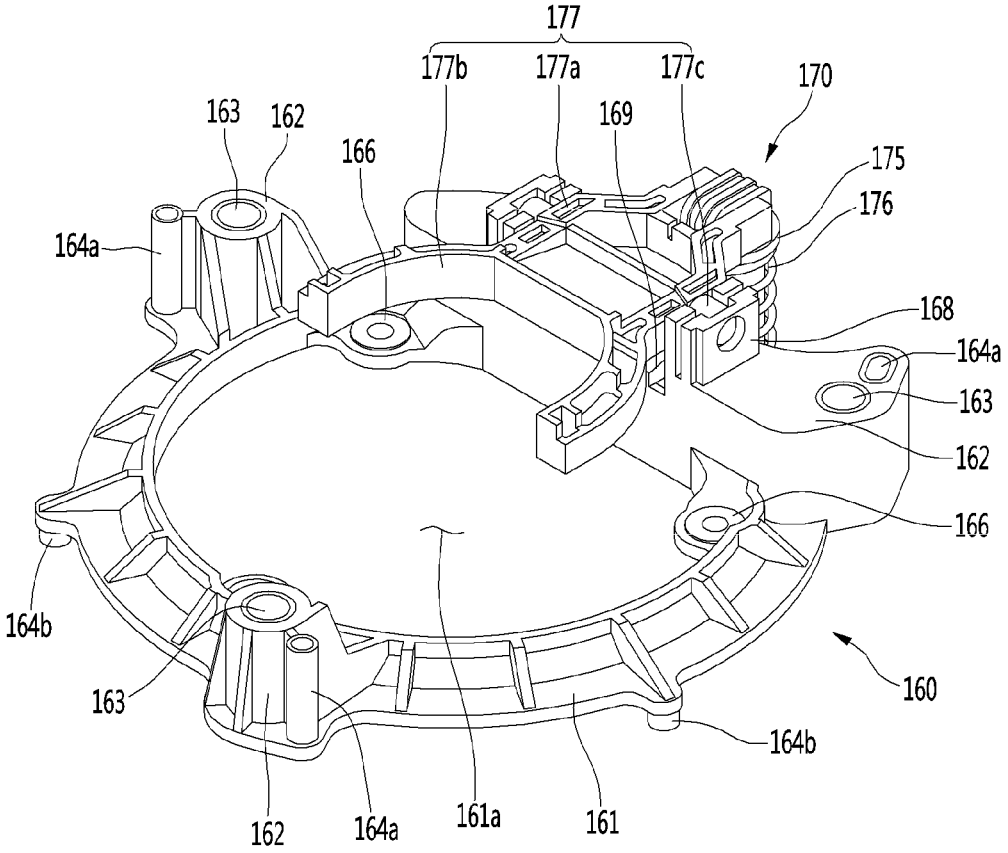
FIG. 11 is a bottom perspective view illustrating the clutch stopper to which the clutch lever is engaged.
Figure 12:
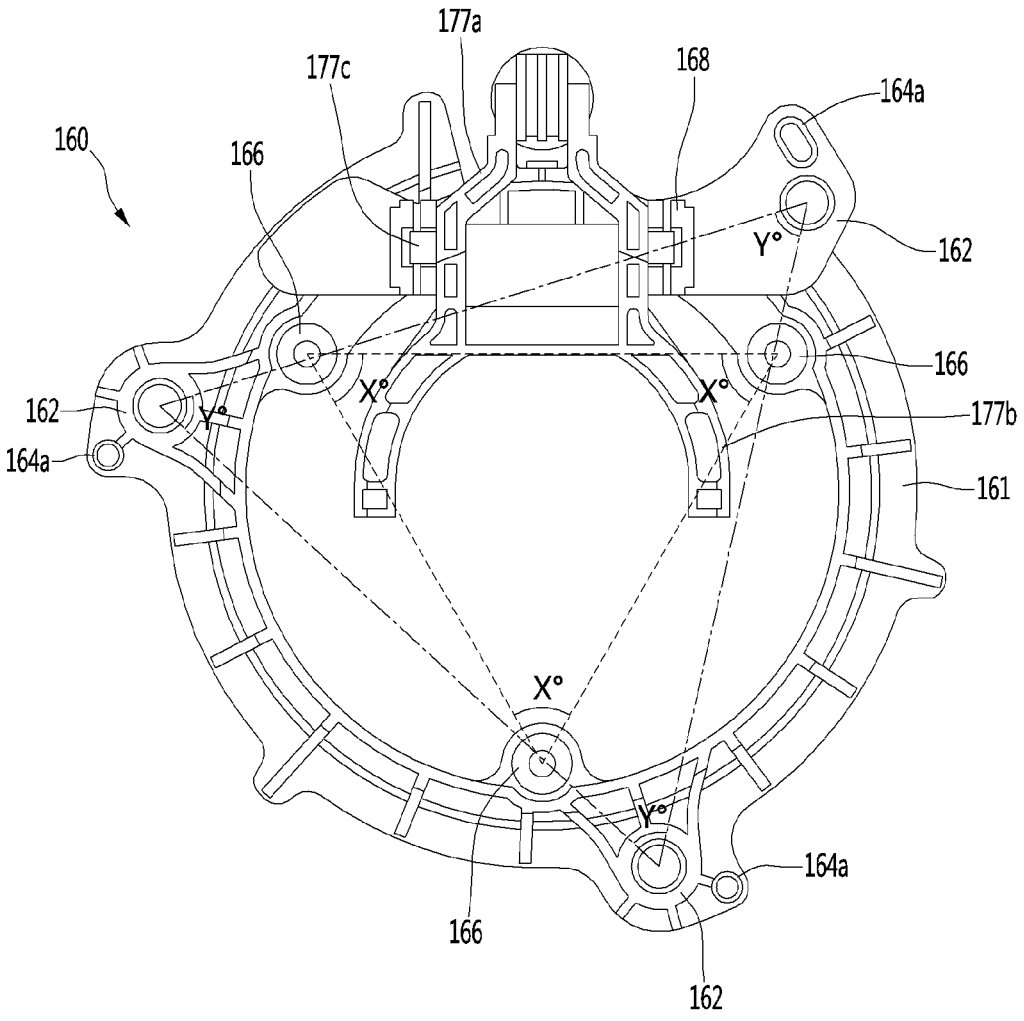
FIG. 12 is a bottom view illustrating the clutch stopper illustrated in FIG. 11.
Figure 13:
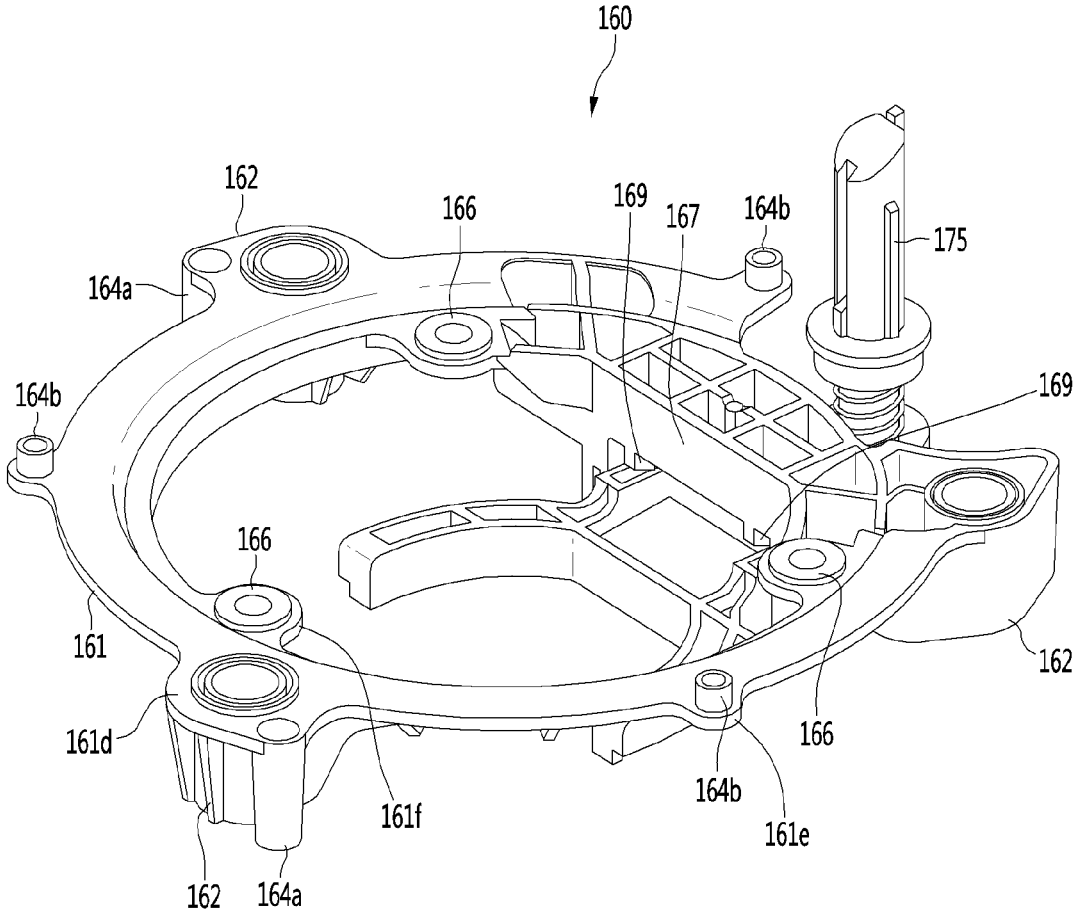
FIG. 13 is a planar perspective view illustrating the clutch stopper to which the clutch lever is coupled.

FIG. 10 is a bottom perspective view illustrating a clutch stopper according to an embodiment of the present invention, FIG. 11 is a bottom perspective view illustrating the clutch stopper to which the clutch lever is engaged, FIG. 12 is a bottom view illustrating the clutch stopper illustrated in FIG. 11, and FIG. 13 is a planar perspective view illustrating the clutch stopper to which the clutch lever is coupled.

As described above, the clutch stopper 160 is disposed on the lower side of the bearing housing 130 and the driving motor including the stator 180 is disposed on the lower side of the clutch stopper 160. In other words, the clutch stopper illustrated in FIGS. 10 to 12 is a perspective view illustrating a state where the clutch stopper is turned upside down, and when mounted on the washing machine, the clutch stopper is mounted on the bottom surface of the bearing housing 130 in a state of FIG. 13.

The clutch stopper 160 is installed between the bearing housing 130 and the stator 180 and can serve as a damper for reducing vibration transferred to the bearing housing 130 due to rotation of the stator 180. The clutch stopper 160 is formed of a plastic resin and can be integrally injection-molded.

Referring to FIGS. 10 to 13, the clutch stopper 160 includes a base portion 161 having an opening 161*a* formed therein. The opening 161*a* can be understood as a hole through which the lower dewatering shaft 125 extending from the lower portion of the bearing housing 130 passes. For example, the opening 161*a* may be formed in a circular shape, but may be formed in a non-circular shape or a polygonal shape.

The base portion 161 may have a disc shape. At this time, the outer diameter of the base portion 161 may be smaller than the inner diameter of the stator 180.

An extension portion 161*b* extends upwardly in the drawing in the form of a sleeve on the inner edge of the base portion 161 and extends downward when mounted on the bearing housing 130. A plurality of reinforcing portions 161*c* may radially extend on the bottom surface (upper surface in the drawing) of the base portion 161 and a plurality of the reinforcing portions 161*c* may be spaced apart from each other in the circumferential direction of the opening 161*a*. The reinforcing portion 161*c* connects the outer circumferential surface of the extending portion 161*b* and the bottom surface of the base portion 161 to improve the strength of the base portion 161 and to disperse the stress.

In addition, a plurality of main flanges 161*d* and a plurality of dummy flanges 161*e* may protrude from the outer edge of the base portion 161. The plurality of main flanges 161*d* and the plurality of dummy flanges 161*e* may be alternately spaced apart from each other in the circumferential direction of the base portion 161. For example, three main flanges 161*d* and three dummy flanges 161*e* may be provided, but the present invention is not limited thereto.

In addition, a plurality of inner flanges 161*f* may extend from the inner edge of the base portion 161.

A fastening boss 162 for fixing to the bearing housing 130 is formed on the bottom surface of the main flange 161*d*. A fastening member passing through the stator 180 passes through the fastening boss 162 and is fastened to the bearing housing 130 so that the bearing housing 130, the clutch stopper 160, and the stator 180 are fixed together.

The fastening boss 162 extends a predetermined length from the bottom surface of the base portion 161 so that the stator 180 contacts only the end portion of the fastening boss 162 to minimize vibration transferring. In order to minimize the contact area where the upper surface of the base portion 161 contacts the bottom surface of the bearing housing 130, at the upper surface of the base portion 161 which corresponds to the upper surface of the tightening boss 162, the sleeve can protrude by about 1 mm. The coupling member may be fixed to the bottom surface of the bearing housing 130 through the sleeve.

This structure minimizes the contact area between the clutch stopper 160 and the bearing housing 130 so that the transferring of the vibration generated in the driving motor to the bearing housing 130 through the clutch stopper 160 can be minimized.

The stator in the related art is fastened to the clutch stopper at six points, while the stator of the present invention is fastened to the clutch stopper 160 at three points. In other words, in a case of the present invention, since the vibration generated in the stator 180 is transferred to the clutch stopper 160 to a lesser extent, the noise is greatly reduced.

In addition, while, in the related art, the stator is in direct contact with the base surface of the clutch stopper and is fastened thereto, in the present invention, the stator 180 is fastened to the fastening boss 162 protruding from the base portion 161 at a predetermined height, the vibration generated in the stator 180 is prevented from being directly transferred to the clutch stopper 160, and consequently vibration noise is reduced.

In addition, in the present invention, a sleeve tube 163 is inserted into the fastening boss 162 to improve the fastening force of the fastening member. The sleeve tube 163 can be inserted into the fastening boss 162 by insert injection.

The sleeve tube 163 is formed in a hollow cylindrical shape and is made of a metal material. The sleeve tube 163 is a portion that is substantially penetrated by the fastening member. The sleeve tube 163 is inserted into the through-hole of the fastening boss 162 to improve the strength of the fastening boss 162 and improve the fastening force of the fastening member. In other words, even if the fastening force increases by tightening the fastening member which passes through the fastening boss 162 to an appropriate level or higher, the fastening boss 162 can be prevented from being broken.

More specifically, the fastening boss 162 is formed of a plastic material. In this case, the strength of the fastening boss 162 and the fastening force of the fastening member may be lowered due to plastic expansion or contraction of the fastening boss 162 due to temperature change. Therefore, in the present invention, a metal sleeve tube can be used to keep a constant clamping force in order to prevent a decrease in the strength and a decrease in the fastening force that may occur due to the temperature change of the plastic material.

In addition, the base portion 161 is provided with a plurality of guide portions 164 for facilitating alignment of the relative structure (for example, stator, bearing housing, or the like). The guide portion 164 can be understood as a structure for guiding alignment for assembly (fastening) between the clutch stopper 160, the bearing housing 130 and/or the stator 180. Specifically, the guide portion 164 may include a lower guide portion 164*a* extending from the bottom surface of the base portion 161 and an upper guide portion 164*b* extending from the upper surface of the base portion 161.

The lower guide portion 164*a* may be formed on the bottom surface of the main flange 161*d* and may be formed on the side of the fastening boss 162.

In the present embodiment, the lower guide portion 164*a* may be disposed at an adjacent position so as to be connected to the fastening boss 162. According to such a configuration, the lower guide portion 164*a* can be easily positioned for assembly between the clutch stopper 160 and the stator 180. To this end, a hole or groove for inserting the lower guide part 164*a* is formed at the inner edge of the stator 180.

The upper guide portion 164*b* may extend from the upper surface of the dummy flange 161*e*. Accordingly, the upper guide portion 164*b* can easily indicate a correct position for assembling between the clutch stopper 160 and the bearing housing 130.

Six fastening holes 133 are formed on the bottom surface of the bearing housing 130 of the present invention as well as the bearing housing of the related art. In addition to the stator 180 of the present invention, six coupling projections 185 are also protruded in the inner edge of the stator of the related art. A fastening hole 186 is formed in each fastening protrusion portion 185.

The fastening member passing through the fastening hole 186 passes through the fastening boss 162 and is inserted into the fastening hole 133 formed in the bottom of the bearing housing 130.

Here, the clutch stopper 160 according to the embodiment of the present invention differs from the clutch stopper structure of the related art in that only three fastening bosses 162 serve as connection portions for connecting the stator 180 and the bearing housing 130 and the three upper guide portions 164*b* function as shielding means fix shielding the remaining three fastening holes 133.

In other words, the three upper guide portions 164*b* are inserted into the three fastening holes 133 of the six fastening holes 133, thereby facilitating the positional alignment of the clutch stopper 160. As a result, the stator 180 may be supported at three points on the bottom surface of the bearing housing 130.

In addition, although the fastening member is inserted into the through-hole other than the through-holes corresponding to the fastening bosses 162 among the six through-holes 185 formed on the inner edge of the stator 180 due to the confusion of the assembler by the upper guide portion 164*b* being inserted into the fastening hole 133 formed in the bottom surface of the bearing housing 130, since the fastening members are blocked by the dummy flanges 161*e* and are not inserted any more, it is possible to prevent erroneous assembly.

In addition, an auxiliary coupling portion 166 may be further formed on the upper surface of the inner flange 161*f*. A fastening hole may be formed in the bottom surface of the bearing housing 130 corresponding to the auxiliary coupling portion 166 when the clutch stopper 160 is coupled to the bottom surface of the bearing housing 130. The clutch stopper 160 is supported at six points on the bottom surface of the bearing housing 130 by inserting the fastening member through the auxiliary coupling portion 166 into the hearing housing 130. Therefore, the clutch stopper 160 having the stator 180 coupled to the bottom surface can be stably coupled and supported on the bottom surface of the bearing housing 130.

The auxiliary coupling portion 166 may protrude from the upper surface of the inner flange 161*f* by about 1 mm so as to minimize the contact area between the upper surface of the base portion 161 and the bottom surface of the bearing housing 130.

In addition, a seating portion 167 on which the clutch lever 177 is seated is further formed on the bottom surface (upper surface in FIG. 10) of the base portion 161. The seating portion 167 is formed to have a predetermined width so that the clutch lever 177 for raising and lowering the coupler 150 is positioned.

On the left and right edges of the seating portion 167, a hinge coupling portion 168 to which the clutch lever 177 is rotatably engaged is formed. Specifically, the hinge coupling portion 168 is formed to extend further downward from both side end portions of the seating portion 167. A seating groove 168*a* for seating the fixing pin 177*c* of the clutch lever 177 and a hinge hole 168*b* for receiving the fixing pin 177*c* are formed at the end portion of the hinge coupling portion 168.

In addition, one or a plurality of stopper ribs 169 may be protruded from the seating portion 167 to keep the rotation amount (rotation angle) of the clutch lever 177 constant. In this embodiment, the protrusion of a pair of stopper ribs 169 will be described as an example. The stopper rib 169 substantially contacts the upper surface of the connection portion 177*a* constituting the clutch lever 177. In other words, the bottom surface of the stopper rib 169 contacts at least a portion of the upper surface of the connection portion 177*a*.

The end portion of the stopper rib 169 may be inclined upward toward the center of the clutch stopper 160. In other words, the stopper rib 169 may be formed to have an inclined surface inclined upward from the outside toward the inside. Hereinafter, the operation of the stopper rib will be described in detail with reference to the drawings.

Figure 14:
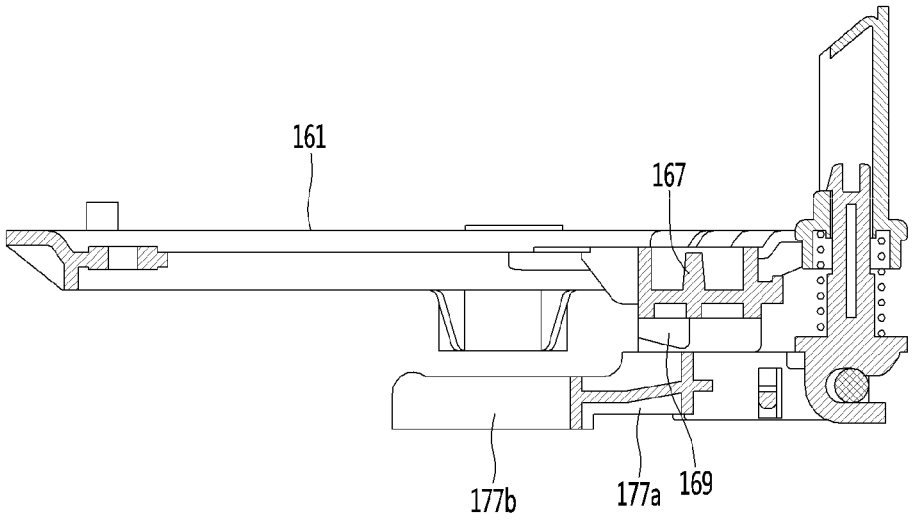
FIG. 14 is a longitudinal sectional view illustrating the clutch stopper and the clutch lever in the dewatering mode according to the embodiment of the present invention.
Figure 15:
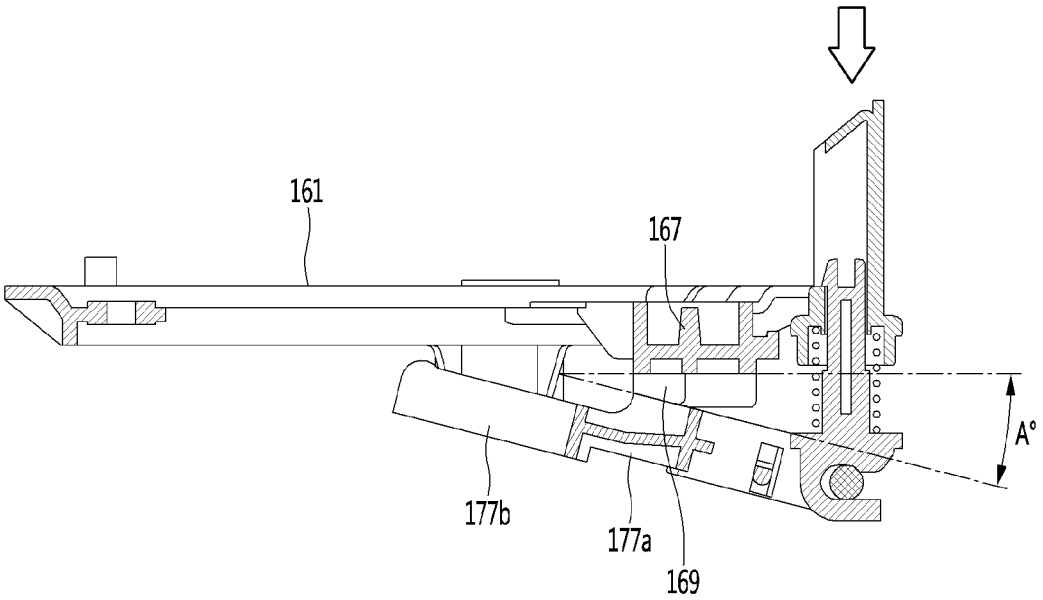
FIG. 15 is a longitudinal sectional view illustrating the clutch stopper and the clutch lever in the washing mode according to the embodiment of the present invention.

FIG. 14 is a longitudinal sectional view illustrating the clutch stopper and the clutch lever in the dewatering mode according to the embodiment of the present invention, and FIG. 15 is a longitudinal sectional view illustrating the clutch stopper and the clutch lever in the washing mode according to the embodiment of the present invention.

First, referring to FIG. 14, when a dewatering command is input to the washing machine 1, the clutch lever 177 is horizontally placed below the stopper rib 169. At this time, the connection portion 177*b* of the clutch lever 177 may be partially in contact with the upper surface of the stopper rib 169.

Referring to FIG. 14, the stopper rib 169 has an inclined surface inclined upward from the right side to the left side. The connection portion 177*b* is in contact with the cusp of the lower end portion of the inclined surface of the stopper rib 169 (right side in the drawing). Therefore, in the dewatering mode, the clutch lever 177 can be supported by the stopper rib 169 to keep the horizontal state constant.

Meanwhile, referring to FIG. 15, when a washing command is input to the washing machine 1, the clutch lever 177 is rotated in a direction (upper side in the drawing) in which the coupler 150 is pushed up in a state of being hinged to the clutch stopper 160. In other words, the clutch lever 177 is rotated by a predetermined angle by the urging of the mover 174 by the driving of the clutch motor.

At this time, the rotation of the clutch lever 177 is guided by the inclined surface of the stopper rib 169, while the clutch lever 177 moves in a direction (upper side in the drawing) in which the coupler 150 is pressed upward. When the clutch lever 177 is rotated as full as possible in the direction in which the coupler 150 is pressed, the entire inclined surface formed at the end portion of the stopper rib 169 is brought into contact with the clutch lever 177 so that the rotation of the clutch lever 177 is limited. Specifically, in the course of the rotation of the clutch lever 177, the clutch lever 177 is caught by the end portion of the stopper rib 169 and cannot rotate anymore. In other words, the stopper rib 169 may function as a limiting member for limiting the rotation amount of the clutch lever 177.

Here, an angle formed by an extension line passing through the upper surface of the stopper rib 169 and an extension line passing through the inclined surface of the stopper rib 169 may be 15 degrees. In other words, the clutch lever 177 can be rotated by 15 degrees by the stopper rib 169 in a horizontal state. However, the present invention is not limited thereto, and the inclined angle of the stopper rib 169 may be variously designed.

Figure 16:
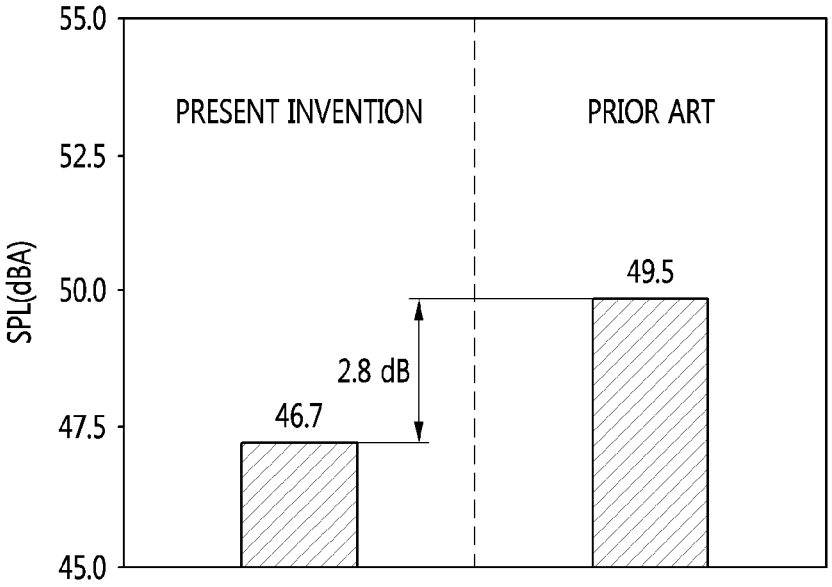
FIG. 16 is a graph illustrating the effect of noise reduction during washing operation according to an embodiment of the present invention.

FIG. 16 is a graph illustrating the effect of noise reduction during washing operation according to an embodiment of the present invention, FIG. 16 is a graph illustrating a comparison between an average noise detected in a washing machine in which a stator according to the present invention is fastened to the clutch stopper with three points and an average noise detected in a washing machine in which the stator according to the related art is fastened to the clutch stopper with six points, during the washing operation.

As illustrated in FIG. 16, it can be seen that the noise when adopting the structure according to the embodiment of the present invention occurs significantly less than the noise when adopting the structure according to the related art.

Specifically, in the washing machine to which the three-point fastening of the present invention is applied, the average noise generated in the washing operation was detected to be 46.7 dBA, and in the washing machine to which the six-point fastening of the related art is applied, the average noise generated in the washing operation was detected to be 49.5 dBA.

In other words, it is confirmed that the noise generated in the washing machine to which the present invention is applied is reduced by a maximum of 2.8 dBA compared to the noise generated in the conventional washing machine.

According to the configuration of the present invention described above, the clutch stopper is provided with a plurality of fastening bosses protruding toward the stator. Therefore, since the contact surface where the upper mounting surface of the stator and the lower surface of the clutch stopper are contacted is minimized, vibration noise transferred to a side of the bearing housing through the clutch stopper can be greatly reduced.

In addition, the clutch stopper is provided with a stopper rib for keeping the operation amount (rotation amount) of the clutch lever constant. Therefore, since the force applied to the coupler by the clutch lever is kept constant, there is an advantage that the wear of the component due to the friction is reduced.

In addition, since the stopper rib is provided in the clutch stopper, it is not necessary that the serration provided on the upper portion of the coupler is engaged with the clutch stopper when the coupler is raised and lowered. Therefore, there is an advantage that a separate tooth engaging portion can be omitted in the clutch stopper, thereby making the manufacturing cost low.

In addition, a sleeve of a metal tube is additionally inserted into the fastening boss of the clutch stopper. Therefore, the fastening force of the fastening member can be improved, and the decrease in the strength of the fastening boss and the decrease in the fastening force of the fastening member due to the temperature change of the fastening boss can be prevented.

In addition, since the clutch stopper is provided with a guide portion for aligning with a relative structure (for example, stator, bearing housing, and the like), there is an advantage that erroneous assembly can be prevented in advance when assembling components.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a case;

an outer tub located inside of the case;

an inner tub located inside of the outer tub;

a pulsator located inside of the inner tub and configured to rotate relative to the inner tub; and a driving unit located at an outer surface of the outer tub and configured to provide driving force to cause rotation of at least one of the inner tub or the pulsator, wherein the driving unit comprises:

a bearing housing located vertically below the outer tub, a clutch stopper located at a bottom surface of the bearing housing, and a driving motor comprising a stator and a rotor that is coupled to a lower side of the clutch stopper, and wherein the clutch stopper is located between the stator and the bearing housing, and comprises:

a base portion located at the bottom surface of the bearing housing, and a fastening boss that extends from the base portion to the lower side of the clutch stopper, wherein the stator, the fastening boss, and the bearing housing are fastened together by a fastening member.

2. The washing machine according to claim 1, wherein the bearing housing receives the fastening member at the bottom surface of the bearing housing through the stator and the fastening boss.

3. The washing machine according to claim 1, wherein the stator is supported by a plurality of fastening members fastened to at least three points of the bottom surface of the bearing housing.

4. The washing machine according to claim 1, wherein the base portion defines an opening inside the base portion, and wherein the fastening boss comprises a plurality of fastening bosses arranged along an outer edge of the base portion and spaced apart from one another.

5. The washing machine according to claim 4, wherein the driving unit further comprises a plurality of main flanges that extend radially outward from the outer edge of the base portion and that are spaced apart from one another in a circumferential direction of the base portion.

6. The washing machine according to claim 5, wherein each of the plurality of fastening bosses extends from one of the plurality of main flanges to the lower side of the clutch stopper.

7. The washing machine according to claim 5, wherein the driving unit further comprises a lower guide portion that extends from at least one of the plurality of main flanges to the lower side of the clutch stopper, and wherein the stator defines a lower guide hole configured to receive the lower guide portion.

8. The washing machine according to claim 5, wherein the driving unit further comprises a plurality of dummy flanges that extend radially outward from the outer edge of the base portion and that are spaced apart from one another in the circumferential direction of the base portion.

9. The washing machine according to claim 8, wherein the plurality of dummy flanges are arranged alternately with the plurality of main flanges along the outer edge of the base portion, and wherein one of the plurality of dummy flanges is located between two of the plurality of main flanges.

10. The washing machine according to claim 8, wherein the driving unit further comprises an upper guide portion that extends from at least one of the plurality of dummy flanges to an upper side of the clutch stopper opposite to the lower side of the clutch stopper, and wherein the bottom surface of the bearing housing defines an upper guide hole configured to receive the upper guide portion.

11. The washing machine according to claim 4, wherein the driving unit further comprises a plurality of inner flanges that extend radially inward from an inner edge of the base portion and that are spaced apart from one another in a circumferential direction of the base portion.

12. The washing machine according to claim 11, wherein each of the plurality of inner flanges comprises an auxiliary coupling portion that extends upward from an upper surface of the inner edge of the base portion to an upper side of the clutch stopper opposite to the lower side of the clutch stopper, the auxiliary coupling portion being configured to be coupled to the bottom surface of the bearing housing by a fastening member.

13. The washing machine according to claim 1, wherein the driving unit further comprises a sleeve tube made of a metal material and inserted in the fastening boss.

14. The washing machine according to claim 13, wherein the sleeve tube has an upper end portion positioned vertically higher than the fastening boss or an upper end portion of the base portion.

15. The washing machine according to claim 1, further comprising:

a planetary gear module located in the bearing housing and configured to rotate relative to the bearing housing;

a dewatering shaft coupled to the planetary gear module and configured to rotate the inner tub based on selectively receiving rotation force from the rotor; and a washing shaft that is positioned in the dewatering shaft, that is connected to the planetary gear module and to the rotor, and that is configured to receive rotation force from the rotor to rotate the pulsator.

16. The washing machine according to claim 15, further comprising:

a coupler configured to vertically move along an outer circumferential surface of the dewatering shaft and configured to selectively connect the dewatering shaft to the rotor; and a clutch mechanism configured to cause the coupler to vertically move along the outer circumferential surface of the dewatering shaft.

17. The washing machine according to claim 16, wherein the clutch mechanism comprises:

the clutch stopper; and a clutch lever configured to rotate relative to the clutch stopper to move the coupler upward, the clutch lever comprising a first end portion configured to connect to a side of the clutch stopper and a second end portion configured to connect to the coupler.

18. The washing machine according to claim 17, wherein the base portion defines an opening configured to receive the dewatering shaft, wherein the clutch stopper further comprises a plurality of main flanges that extend from an edge of the base portion and that are spaced apart from one another in a circumferential direction of the base portion, and wherein the fastening boss extends from at least one of the plurality of main flanges to the lower side of the clutch stopper.

19. The washing machine according to claim 18, wherein the base portion defines a seating portion that receives at least a portion of the clutch lever, the seating portion comprising a pair of hinge coupling portions, and wherein the clutch lever comprises a hinge shaft rotatably coupled to the pair of hinge coupling portions.

20. The washing machine according to claim 1, wherein the clutch stopper faces each of the stator and the bearing housing, and wherein the fastening member is a single fastening member that penetrates the stator, the clutch stopper, and the bearing housing.

* * * * *